US010253534B2

(12) United States Patent
Haussermann

(10) Patent No.: US 10,253,534 B2
(45) Date of Patent: Apr. 9, 2019

(54) DOOR HANDLE DEVICE

(71) Applicant: Dr. Ing. h.c. F. Porsche Aktiengesellschaft, Stuttgart (DE)

(72) Inventor: Martin Haussermann, Leutenbach (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 250 days.

(21) Appl. No.: 15/014,319

(22) Filed: Feb. 3, 2016

(65) Prior Publication Data

US 2016/0230430 A1 Aug. 11, 2016

(30) Foreign Application Priority Data

Feb. 5, 2015 (DE) ..... 10 2015 101 630

(51) Int. Cl.
*E05B 85/18* (2014.01)
*E05B 77/42* (2014.01)

(52) U.S. Cl.
CPC ..... *E05B 85/18* (2013.01); *E05B 77/42* (2013.01)

(58) Field of Classification Search
CPC ..... Y10T 292/57; E05B 77/36; E05B 77/42; E05B 77/38; E05B 85/10; E05B 85/14; E05B 85/18; Y10S 292/08; Y10S 292/10; Y10S 292/28; Y10S 292/56; Y10S 292/57; Y10S 292/63; Y10S 292/73
See application file for complete search history.

(56) References Cited

U.S. PATENT DOCUMENTS 5,092,642 A 3/1992 Lindmayer et al.
6,234,041 B1 * 5/2001 Larabet ..... E05B 85/16 74/523
2001/0037702 A1 * 11/2001 McFarland ..... E05B 77/42 267/140.11
2002/0036409 A1 3/2002 Lambertz et al.
2005/0160559 A1 7/2005 Hayashi
(Continued)

FOREIGN PATENT DOCUMENTS

DE 100 30 331 1/2002
DE 102012104777 A1 12/2012
(Continued)

OTHER PUBLICATIONS

Computer Generated Translation for DE 10030331, Generated on Jan. 30, 2018, https://worldwide.espacenet.com/ (Year: 2018).*
German Search Report dated Oct. 19, 2015.

*Primary Examiner* — Alyson M Merlino
(74) *Attorney, Agent, or Firm* — Gerald E. Hespos; Michael J. Porco; Matthew T. Hespos

(57) ABSTRACT

A door handle device (1) for a motor vehicle has a holding device (2) with a door handle (6) arranged on an outer side (3) of the holding device (2) so as to be pivotable between a basic position (4) and a pivoted opening position (5). A damping device (7) is provided for damping a closing movement (8) of the door handle (6) from the pivoted opening position (5) into the basic position (4). A pivotable balancing device (10) for interaction with the damping device (7) is arranged on an inner side (9) of the holding device (2) and is coupled via a coupling device (11) to the door handle (6) so that a pivoting movement of the door handle (6) brings about an opposite rotational movement of the balancing device (10).

16 Claims, 3 Drawing Sheets

(56) References Cited

U.S. PATENT DOCUMENTS

| | | | | |
|---|---|---|---|---|
| 2013/0170241 | A1* | 7/2013 | Lesueur | E05B 77/06<br>362/501 |
| 2016/0290018 | A1* | 10/2016 | Hamacher | E05B 77/42 |

FOREIGN PATENT DOCUMENTS

| | | | |
|---|---|---|---|
| DE | 20 2011 051 81 | | 3/2013 |
| EP | 0419809 | A1 | 4/1991 |
| FR | 2 960 898 | | 12/2011 |
| JP | 2000054692 | A | 2/2000 |
| WO | 2012/175599 | | 12/2012 |
| WO | 2014/013040 | | 1/2014 |

* cited by examiner

DOOR HANDLE DEVICE

CROSS REFERENCE TO RELATED APPLICATION

This application claims priority under 35 USC 119 to German Patent Appl. No. 10 2015 101 630.3 filed on Feb. 5, 2015, the entire disclosure of which is incorporated herein by reference.

BACKGROUND

1. Field of the Invention

The invention relates to a door handle device, in particular for a motor vehicle, comprising a holding device with a door handle that is arranged on an outer side of the holding device so as to be pivotable between at least one basic position and at least one pivoted opening position. At least one damping device is provided for at least partially damping a closing movement of the door handle from the pivoted opening position into the basic position.

2. Description of the Related Art

The prior art includes a very wide variety of door handle devices for motor vehicles in which a door outside handle is pivotable from a closed into an open position. For example, FR 2 960 898 A1 discloses a door handle that is arranged pivotably on the bodywork. The disclosed door handle arrangement has a chamber with by an elastic wall. The chamber is filled with air for damping the closing movement of the door handle and to reduce the closing noise. The elastic air chamber always is subjected to the contact pressure of the door handle in the closed state of the door. Furthermore, the elastic air chamber is fit on the outer side of the vehicle and therefore is exposed to environmental influences. As a result, aging phenomena may occur and the operability may diminish over time.

DE 100 30 331 A1 discloses a door outside handle for vehicles. A piston-cylinder device is arranged on the inner side and functions for damping the operation of the door outside handle,. However, damping disadvantageously takes place during the closing movement of the outside door handle, and a considerable resistance occurs during the opening movement. In addition, the structural outlay is relatively large.

It is therefore the object of the invention to provide a door handle device which reliable damping takes place during the closing movement of a door handle.

SUMMARY

A door handle device according to the invention is provided for use on a motor vehicle and comprises a holding device with a door handle arranged on an outer side of the holding device so as to be pivotable between at least one basic position and at least one pivoted opening position. At least one damping device is provided for at least partially damping a closing movement of the door handle from the pivoted opening position into the basic position. A pivotable balancing device for interaction with the damping device is arranged on an inner side of the holding device. The pivotable balancing device is coupled via a coupling device to the door handle so that a pivoting movement of the door handle brings about an opposite rotational movement of the balancing device. The pivot axis about which the door handle pivots can be horizontal or vertical.

The door handle device can comprise a door handle designed as an outside door handle.

The door handle device of the invention has many advantages. One considerable advantage of the door handle device is that the door handle is coupled via a coupling device to a pivotable balancing device. As a result, it is possible for the damping of the movement of the door handle to be decoupled from the door handle itself. The coupling device and the coupling of the balancing device to the door handle enables the damping to take place at the balancing device.

A further advantage is that a pivoting movement of the door handle brings about an opposite rotational movement of the balancing device, and therefore an inadvertent actuation or an inadvertent opening of the door in the event of a transverse acceleration is prevented reliably.

The balancing device may comprise at least one balancing bracket that is pivotable in a direction opposite to the door handle. The balancing device also may be formed by the balancing bracket. An integrally formed balancing weight or a separately attached balancing weight can be provided at the end of the balancing bracket or the end of the balancing device to provide a counterweight. The balancing weight need not be at the remote end of the balancing bracket and can be spaced somewhat from the end.

The damping device may comprise at least one air buffer. The air buffer may have at least one outflow opening. However, an air buffer can be formed without an opening and can have an elastic wall on which the balancing device or the coupling device acts to form the damping device.

The damping device may comprise at least one wall made of an elastic material. The wall can form and delimit an air volume. The air buffer can be ball-shaped, peg-shaped, eggshaped, hemispherical, funnel-shaped or cylindrical, and may be acted upon with pressure by the balancing device during the closing movement so that the air buffer brings about a damping of the closing movement.

The air buffer may have at least one inflow opening that is at least substantially closed indirectly or directly by the balancing device during the closing movement. The balancing device may strike indirectly or directly against the inflow opening of the air buffer so that the inflow opening of the air buffer is closed and the air buffer brings about a damping of the closing movement.

The air buffer may have an inflow opening of this type, into which a correspondingly designed part of the balancing device enters during the closing movement. For example, a piston-like part of the balancing device of can enter into a correspondingly configured (e.g. round or cylindrical) part of the air buffer to damp a closing movement. In these refinements, the air buffer may have at least one outflow opening through which compressed air can escape.

A rough gap size may exist between an entering piston and the air buffer wall surrounding the piston. Thus, an outflow opening is provided between the outer side of the piston and the inner side of the wall. In an alternative refinement, the balancing device strikes against the outflow opening of the air buffer. Thus, part of the balancing device that bears against the air buffer does not bear against the full surface area, and therefore an outflow opening is provided.

In one development, the entire area of all of the inflow openings is larger than the entire area of all of the outflow openings. For example, the air buffer can be of hemispherical or funnel-shape, with the inflow opening at one end and an outflow opening at another end.

The balancing device may act on a plurality of air buffers, and the action can take place simultaneously or in a temporally offset manner. For example, two or more air buffers can be loaded simultaneously by the balancing device.

Alternatively, a first air buffer can be loaded and subsequently a second and/or a third.

In all of the refinements, the balancing device may have at least one balancing weight. It is possible for the balancing device to comprise two balancing brackets that are spaced apart from each other and are connected to each other, for example, via a balancing weight. The balancing weight can directly provide the stop surface for the air buffer or the air buffers.

A balancing weight on the balancing device leads to greater inertia, and therefore an undesired or inadvertent opening of the door handle during a transverse acceleration of the motor vehicle is prevented.

The door handle and the balancing device may pivot about the same pivot axis. One of the two components can then be connected to the pivot axis for rotation therewith while the other is arranged rotatably on the pivot axis. However, the door handle and the balancing device may be pivotable about different pivot axes. The two components can be fastened to the respective pivot axis for rotation therewith or in a rotatable manner.

The door handle and the balancing device can be coupled to each other via the coupling device over at least one pivoting angle range and may be coupled to each other at least substantially over the complete pivoting range.

The coupling device may have at least one rotation reversal device to ensure that, during pivoting of the door handle in one direction of rotation, the balancing device is pivoted in the other direction of rotation.

The coupling device may comprise a first gear wheel coupled to the door handle for rotation therewith and a second gear wheel coupled to the balancing device for rotation therewith. The two gear wheels can engage with or couple to each other directly or indirectly. The two gear wheels may be coupled to each other via a coupling means, such as a belt or a chain. However, it is also possible for further gear wheels and/or toothed belts and/or chains to be provided between the two gear wheels to transmit the rotational movement of the one gear wheel in a coupled manner to the other gear wheel. At least one of the gear wheels may be a friction wheel or a gear wheel.

The door handle may comprise a handle and at least one lateral door lever.

The door handle, in the basic position, may bear against an elastic or soft basic surface. Such an elastic or soft basic surface leads to further damping of the closing movement of the door handle in addition to damping of the damping device.

The door handle device cushions the closing movement with the aid of a balancing bracket that is fastened to the door recess, as a balancing device. During the movement back of the door handle, the balancing bracket of the balancing device likewise drops back and a damping device strikes against one or more air buffers.

The door handle device permits reliable and substantially permanent operation. The construction is structurally simple. The use of air buffers with a large volume is feasable because the air buffers are on the inner side of the door handle device. A reliable and sufficient damping is achieved during the closing movement, while no additional resistance is produced during the opening movement.

Further advantages and features of the invention emerge from the exemplary embodiments that are explained below with respect to the attached figures.

DETAILED DESCRIPTION

Figure 1:
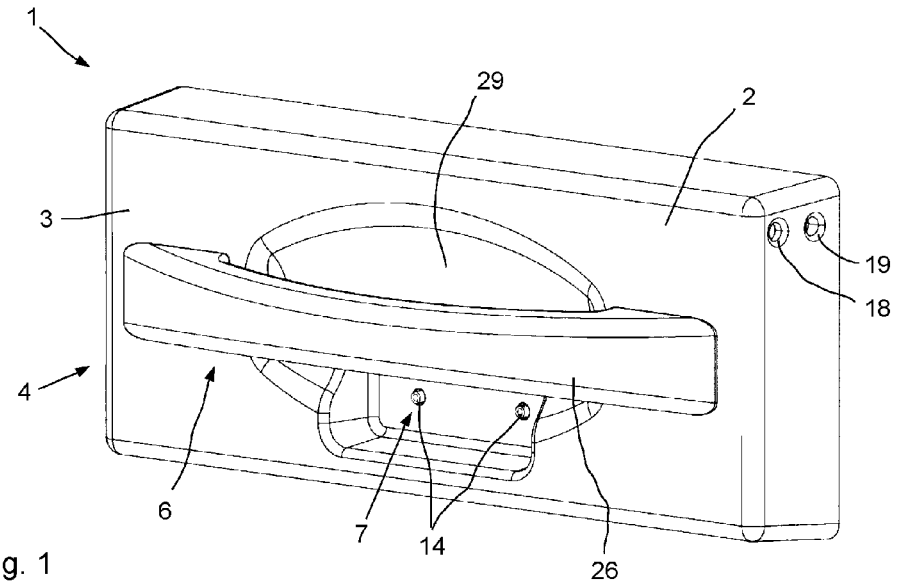
FIG. 1 is a schematic perspective view of a door handle device according to the invention in a basic position.

FIG. 1 is a schematic perspective view of a door handle device 1 according to the invention in a basic position 4 that corresponds to the closed position. In the closed position, the door handle 6 bears against the outer side 3 of the holding device 2.

Figure 2:
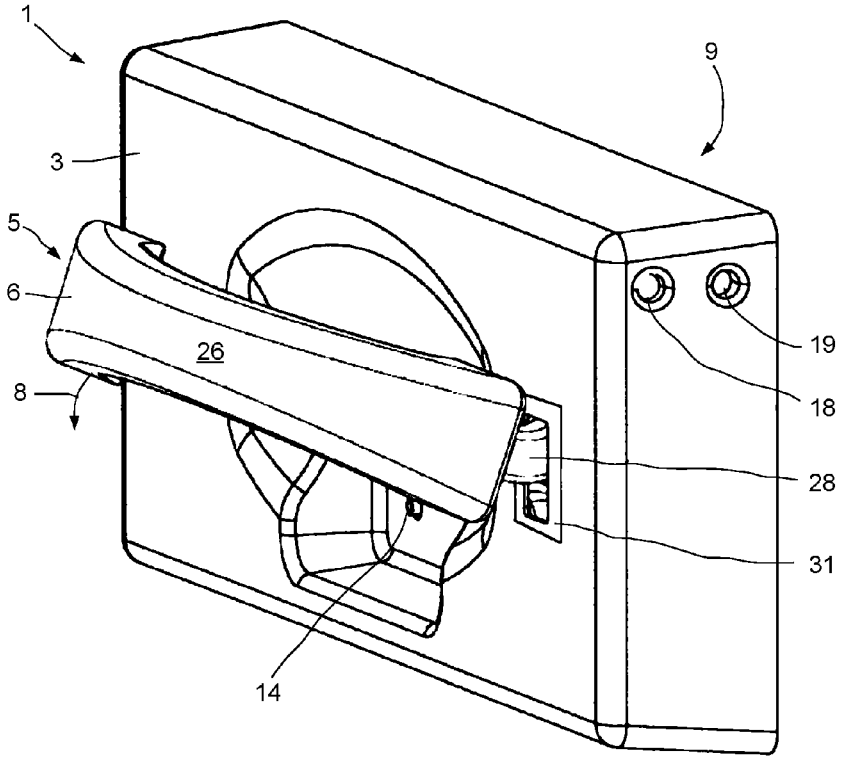
FIG. 2 shows the door handle device of FIG. 1 in an opening position.

The door handle 6 can be pivoted overall via the handle 26 about a pivot axis running approximately horizontally and transferred into the opening position 5 depicted in FIG. 2. The door handle 6 also can be pivotable into further positions that are not illustrated here. These may be intermediate positions, or the door handle can be pivoted further, for example, for special requirements.

The door handle device 1 depicted in FIG. 1 is arranged on a handle recess 29. Two outflow openings 14 of a damping device 7 can be seen here in the interior of the handle recess 29. However, the outflow openings 14 can also be provided outside the recess region of the handle recess 29.

The door handle 6 is arranged to be pivotable about the pivot axis 18 with the door lever 28, which is visible in FIG. 2. The pivot axis 19 serves for the pivotable mounting of a balancing device 10 that is not visible in FIGS. 1 and 2. The pivot axes 18 and 19 are accommodated on the inner side 9 of the holding device 2.

The outer side 3 of the holding device 2 can be the outer surface or the outer skin of a motor vehicle. The holding device 2 can be part of the outer skin or is covered by the outer skin and an external structure.

The door handle 6 can be pivoted in the direction of the arrow 8 for a closing movement that transfers the door handle 6 from the opening position 5 illustrated in FIG. 2 into the basic position 4 illustrated in FIG. 1. At least the end of the pivoting movement is damped by the damping device 7. An additional damping can take place on the holding device 2 by the stop 31 if the stop 31 is made of a soft and/or elastic material, and therefore the remaining speed of the handle 26 is damped additionally during the impact against the stop 31.

A soft pad on the stop 31 can serve for the additional damping but may not be sufficient—depending on construction space specifications—if the pad is relatively thin and consequently has only a relatively small damping action. The pad of the stop 31 may be soft or may be composed of two or more components hard/soft.

Figure 3:
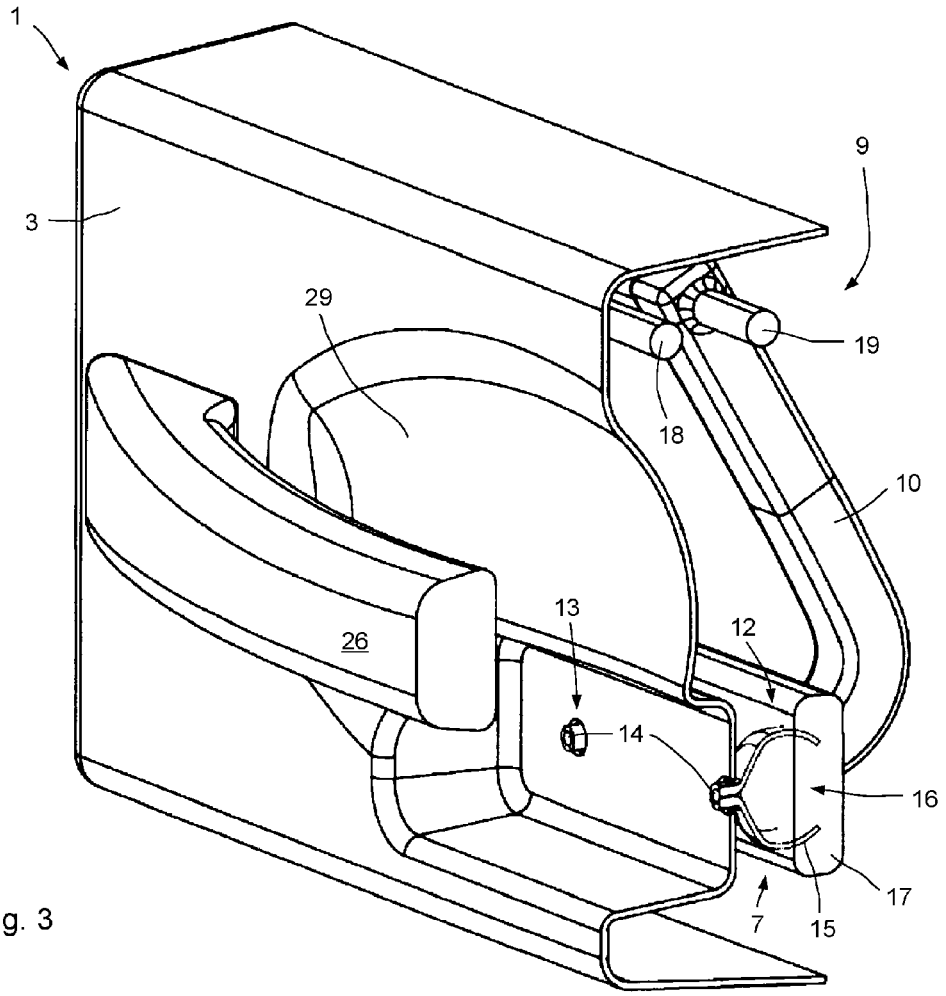
FIG. 3 is a partially sectioned perspective view of the door handle device of FIG. 1.

FIG. 3 is a partially sectioned perspective view of the door handle device 1 of FIG. 1 and illustrates more details of the damping device 7. The damping device 7 comprises two air buffers 12, 13 with outflow openings 14 on the outer side of the handle recess 29 for an outflow of compressed air. Each air buffer 12, 13 is approximately hemispherical and has a wall 15 made of an elastic, such as rubber-like material.

Inner sides of the air buffers 12, 13 have extensive inflow openings 16 with an area that is a multiple of the area of the outflow openings 14. A ratio of the inflow opening 16 to the outflow opening 14 preferably is greater than ten and may be greater than twenty or more.

Figure 4:
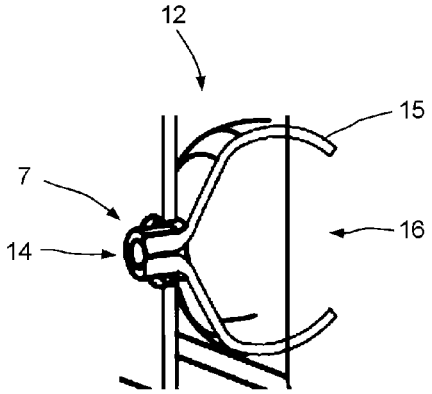
FIG. 4 is an enlarged sectional view of an air buffer of the door handle device of FIG. 1.

One of the balancing brackets of the balancing device 10 is arranged pivotably about the pivot axes 19, as shown in FIG. 4. The balancing bracket extends from the pivot axis 19 and is of generally L-shape. The short leg of the L is at the end opposite the pivot axis 19, and a balancing weight 17 is arranged at the outer end of the short leg. The balancing weight 17 can optionally connect a plurality of separate balancing brackets of the balancing device 10 to one another so that they are pivoted synchronously.

The balancing weight 17 has an approximately cuboidal cross section. In the exemplary embodiment, the inflow opening 16 of the air buffers 12, 13 of the damping device 7 is closed by the balancing weight 17 during the closing movement 8. After the closing of the inflow opening 16, the air buffers 12, 13 are compressed by the mass of the balancing weight 17 so that the elastic wall 15 deforms elastically. At the same time, the interior space of the air buffers 12, 13 is placed under positive pressure while only a small portion of the contained air escapes through the outflow openings 14. As a result, the air buffers 12, 13 form air springs, the spring action of which decreases over time by the gas flowing out. Thus, the balancing weight 17 reliably reaches the end position thereof.

FIG. 4 shows an enlarged schematic cross section through an air buffer 12 of the damping device 7, and clearly shows the elastic wall 15 and the larger inflow opening 16 in comparison to the smaller outflow opening 14. A diameter of the outflow opening 14 can be within the range of the wall thickness of the elastic wall 15.

Figure 5:
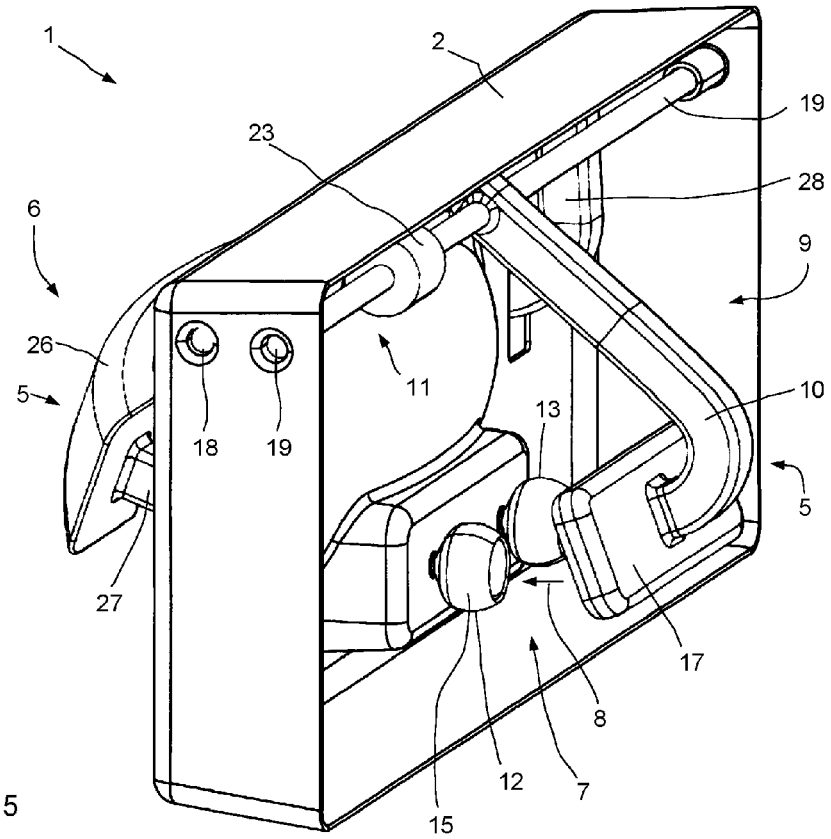
FIG. 5 is an inner view of the door handle device according to FIG. 2.

FIG. 5 shows a schematic perspective view of the door handle device 1 in the opening position 5. The door handle 6 is in the opening position 5, and therefore the door lever 27 is visible. The door lever 27 is pivotable about the pivot axes 18. The pivot axis 18 is coupled via a coupling device 11 to the pivot axis 19 so that a pivoting movement of the door handle 6 about the pivot axis 18 leads to an opposite pivoting movement of the balancing device 10 about the pivot axis 19. The coupling device 11 comprises the second gear wheel 23, as shown in FIG. 5, and is connected here to the pivot axis 19 for rotation therewith. The second door lever 28 can also be seen in the background.

In this embodiment, the balancing device 10 is formed by a balancing bracket, and the balancing weight 17 is fastened thereto. In other refinements, two or more balancing brackets 10 may be provided and may be connected to one another.

The front side of the balancing weight 17 closes the inflow openings 16 of the air buffers 12 and 13 during the pivoting from the opening position 5 into the basic position 4. The air buffers 12 and 13 are deformed elastically during further pivoting movement, while the contained air volume escapes on the outer side of the handle recess 29 through the outflow openings 14, not visible in detail here.

Figure 6:
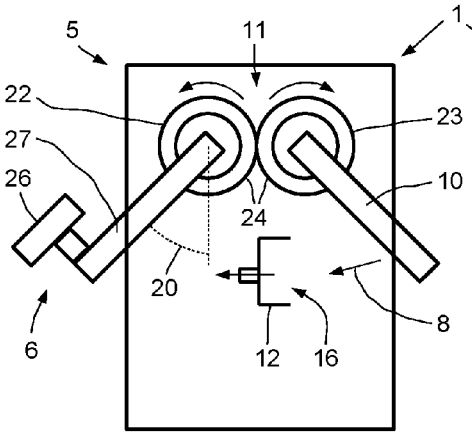
FIG. 6 is a schematic illustration of the operation of the door handle device of FIG. 1.

FIG. 6 shows a schematic cross section through the door handle device 1 together with the operating principle, and shows the door handle 6 and the balancing device 10 connected to each other so as to be pivotable in an opposite direction. This leads to the handle 26 being pivoted out during a pivoting movement of the door handle 6 from the basic position 4 into the opening position 5, while the balancing device 10 is pivoted in the opposite direction and therefore inward. The rotation reversal device 21 is formed by two intermeshing toothed wheels 24, with one of the toothed wheels forming the first gear wheel 22 and the other toothed wheel forming the second gear wheel 23.

In the simplified illustration of FIG. 6, the balancing device 10 strikes against the air buffer 12 of the damping device 7 during the closing movement 8 and closes the inflow opening 16. The outflowing air escapes via the outflow opening 14, and the closing movement 8 is damped.

Figure 7:
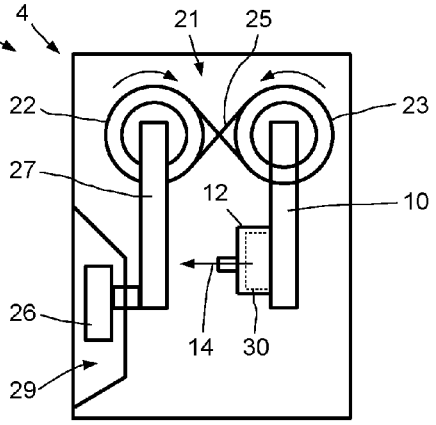
FIG. 7 is a schematic illustration of the operation of a modified door handle device.

FIG. 7 is a highly schematic cross section of a slightly modified the door handle device 1 in the basic position 4. The handle 26 is located here within the door recess 29 and is pivoted out to open the door. As a result, the door lever 27 is pivoted out so that the first gear wheel 22 is rotated in the clockwise direction.

The rotation reversal device 21 is formed by the two gear wheels 22 and 23 and forms a coupling 25 that is wound, for example, around the gear wheels 22, 23 in the shape of an "8". As a result, a clockwise rotation of the first gear wheel 22 causes a counterclockwise rotation of the second gear wheel 23 so that the balancing device 10 is pivoted inward during pivoting of the handle 26 outward.

FIG. 7 shows an embodiment where the balancing device 10 has an entry portion 30 that enters the air buffer 12 and greatly compresses the air present there. The compressed air damps the movements of the balancing device and the door handle 6. Compressed air can escape through the outflow opening 14 thereby ensuring that the end position can be reached. This feature also is possible in other embodiments.

The invention provides an advantageous door handle device in which the door handle and the balancing device are coupled. The balancing device can comprise balancing brackets, counterbrackets or the like. The coupling of the rotation movements can take place via toothed wheels, friction belts, friction wheels or toothed belts or the like.

The damping device for damping the closing movement comprises at least one air buffer with an outlet opening. The air buffer can have an approximately U-shaped cross section or a buffer volume in the shape of a half shell, or the like. The large opening in the air buffer can be closed by the balancing bracket, the balancing device or the like.

The invention provides a door handle device 1 with a bearing bracket and a handle mechanism. The balancing device has a mass balancing weight that serves as a counterweight during the pivoting of the door handle 6. Thus, an unintentional opening of the door handle 6 during a transverse acceleration of a motor vehicle is prevented. The mass balancing weight of the balancing device pivots in the opposite direction with the door handle such that opposed forces are in action.

The disclosed construction enables large-volume air buffers for damping air to be installed in the interior of the holding device or the bearing bracket. The air buffers 12, 13 have an air chamber that is vented only by a small outflow opening 14. As a result, the impact speed of the balancing device 10 is damped and the closing speed of the handle 6 is throttled considerably. The outflow opening 14 ensures that the end position will be reached.

What is claimed is:

1. A door handle device for a motor vehicle, comprising:

a holding device with a door handle arranged on an outer side of the holding device so as to be pivotable between at least one basic position and at least one pivoted opening position;

a damping device for at least partially damping a closing movement of the door handle from the at least one pivoted opening position into the at least one basic position, the damping device having at least one air buffer that includes an outflow opening, at least one wall made of an elastic material, and an inflow opening; and a pivotable balancing device for interaction with the damping device, the pivotable balancing device being arranged on an inner side of the holding device and being coupled via a coupling device to the door handle so that a pivoting movement of the door handle brings about an opposite pivoting movement of the balancing device, wherein the inflow opening of the at least one air buffer is closed at least substantially by the balancing device during the closing movement.

2. The door handle device of claim 1, wherein the inflow opening is larger than the outflow opening.

3. The door handle device of claim 1, wherein the balancing device has at least one balancing weight.

4. The door handle device of claim 1, wherein the door handle and the balancing device are pivotable about two different pivot axes.

5. The door handle device of claim 1, wherein the door handle and the balancing device are coupled to each other via the coupling device over at least one pivoting angle range.

6. The door handle device of claim 1, wherein the coupling device comprises at least one rotation reversal device.

7. The door handle device of claim 1, wherein the door handle comprises two lateral door levers.

8. The door handle device of claim 1, wherein the door handle, in the at least one basic position, bears against an elastic or soft basic surface.

9. A door handle device for a motor vehicle, comprising:

a holding device with a door handle arranged on an outer side of the holding device so as to be pivotable between at least one basic position and at least one pivoted opening position;

a damping device for at least partially damping a closing movement of the door handle from the at least one pivoted opening position into the at least one basic position; and a pivotable balancing device for interaction with the damping device, the pivotable balancing device being arranged on an inner side of the holding device and being coupled via a coupling device to the door handle so that a pivoting movement of the door handle brings about and opposite pivoting movement of the balancing device, wherein the coupling device comprises a first gear wheel coupled to the door handle so as to be rotated during the pivoting movement of the door handle, and a second gear wheel coupled to the balancing device so as to be rotated during the opposite pivoting movement of the balancing device.

10. The door handle device of claim 9, wherein the damping device comprises at least one air buffer with an outflow opening.

11. The door handle device of claim 10, wherein the at least one air buffer comprises at least one wall made of an elastic material.

12. The door handle device of claim 11, wherein the at least one air buffer has an inflow opening that is closed at least substantially by the balancing device during the closing movement.

13. The door handle device of claim 10, wherein the at least one air buffer comprises a plurality of air buffers.

14. The door handle device claim 9, wherein the two gear wheels are coupled via a coupling belt or chain.

15. A door handle device for a door of a motor vehicle, comprising:

a holding device fixed on the door of the vehicle;

a door handle having opposite inner and outer ends, the inner end of the door handle being pivoted to the holding device about a handle pivot axis disposed on an inner side of the holding device so that a lever of the door handle is pivotable between a basic position and a pivoted opening position;

a balancing device disposed on the inner side of the holding device and having a pivoted end pivoted about a balancing pivot axis that is spaced from the door handle and the balancing device having a balancing weight located opposite to the pivoted end;

a coupling extending between the inner end of the door handle and the pivoted end of the balancing device and configured such that a pivoting movement of the door handle to the pivoted opening position generates an opposite pivoting movement of the balancing device and such that a pivoting movement of the balancing device in a direction caused by the balancing weight generates a pivoting movement of the lever of the door handle to the basic position; and a damping device disposed on the inner side of the holding device at a position spaced from of the door handle and at least a portion of the damping device faces the balancing device, the damping device having at least one resilient component that engages the balancing weight as the balancing device pivotally moves in the direction for generating the pivoting movement of the lever of the door handle to the basic position, the at least one resilient component including at least one air buffer with an outflow opening, and the at least one air buffer having an inflow opening that is closed at least substantially by the balancing weight when the at least one air buffer engages the balancing weight.

16. The door handle device of claim 15, wherein the coupling comprises gears extending between the inner end of the door handle and the pivot end of the balancing device.

* * * * *